United States Patent [19]

deVos et al.

[11] 4,242,727

[45] Dec. 30, 1980

[54] LUMINAIRE REFLECTOR

[75] Inventors: Hendrik A. J. deVos; Elzear R. Labouliere, both of Swansea, Mass.

[73] Assignee: GTE Products Corporation, Stamford, Conn.

[21] Appl. No.: 25,257

[22] Filed: Mar. 29, 1979

[51] Int. Cl.[3] ..... F21V 7/00

[52] U.S. Cl. ..... 362/346; 362/263; 362/297; 362/347

[58] Field of Search ..... 362/263, 297, 341, 346, 362/347, 348, 350

[56] References Cited

U.S. PATENT DOCUMENTS

| | | | |
|---|---|---|---|
| 2,242,590 | 5/1941 | Moreau | 362/341 |
| 3,774,995 | 11/1973 | Perret | 362/346 |
| 3,857,030 | 12/1974 | Adam | 362/341 |
| 4,153,929 | 5/1979 | Laudenschlarger | 362/348 |

FOREIGN PATENT DOCUMENTS

| | | | |
|---|---|---|---|
| 1031310 | 5/1978 | Canada | 362/346 |

*Primary Examiner*—Donald P. Walsh
*Attorney, Agent, or Firm*—Lawrence R. Fraley

[57] ABSTRACT

A multi-faceted, segmented reflector for use with a direct lighting luminaire to provide a square pattern of illumination on a planar field located below the luminaire. Each segment is formed as a result of a series of bending operations to thus define a plurality (e.g. six) of the planar facets thereon. The surfaces of the facets are specular reflective to provide greater control of incident light from the luminaire's light source (e.g. HID lamp).

16 Claims, 3 Drawing Figures

LUMINAIRE REFLECTOR

CROSS REFERENCE TO COPENDING APPLICATIONS

An application under Ser. No. 025,258 was filed Mar. 29, 1979, and is assigned to the assignee of the instant invention. Ser. No. 025,258 is entitled "Luminaire" (Inventors: H. A. J. deVos et al) and defines a direct luminaire capable of utilizing the present invention.

An application under Ser. No. 025,256 was also filed Mar. 29, 1979 and assigned to the assignee of the present invention. Ser. No. 025,256, also entitled "Luminaire" (Inventors: E. R. Labouliere et al), is a design application for a direct luminaire.

BACKGROUND OF THE INVENTION

The present invention relates to reflectors and particularly to reflectors for use in luminaires. Even more particularly, the invention relates to reflectors for use in direct luminaires which utilize high intensity light sources to illuminate public areas such as parking lots, malls, parks, concourses, etc.

As will be understood from the following, a significant feature of the present invention is the ability to provide a substantially rectangular pattern of light on a surface located below the luminaire when utilized in the aforedescribed environments. It was heretofore typical of earlier reflector systems as used above to provide symmetrical, circular patterns of light. Accordingly, it was necessary to position the respective luminaires close together to assure the required illumination levels at specified locations within the pattern. Unfortunately, however, the result was an excessive overlapping of adjoining patterns which in turn resulted in both undesirable loss of light and unacceptable uniformities of illumination.

As described, the present invention overcomes the foregoing and associated problems by providing a substantially rectangular light pattern to thereby permit facile accommodation with other, similar patterns in a more efficient manner than typical prior art systems. It is believed that such a reflector constitutes a significant advancement in the art.

OBJECTS AND SUMMARY OF THE INVENTION

It is, therefore, a primary object of the present invention to provide a reflector for use in a direct luminaire which is capable of directing light from the luminaire's light source to produce a rectangular pattern of light on a surface below the luminaire.

It is another object of the invention to provide such a reflector which is lightweight, capable of being produced at low costs, and can be assembled in a relatively easy manner.

Still another object of the invention is to provide a reflector which produces a sharp cut-off angle and is especially adapted for use in luminaires utilizing high intensity discharge (HID) lamps as the desired light source.

These and other objects are achieved by the instant invention which comprises a concave reflector having a plurality of segment members each including several reflective facets thereon. The facets are arranged to reflect light from the luminaire's light sources and produce a substantially rectangular pattern of light on a surface located below the luminaire.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
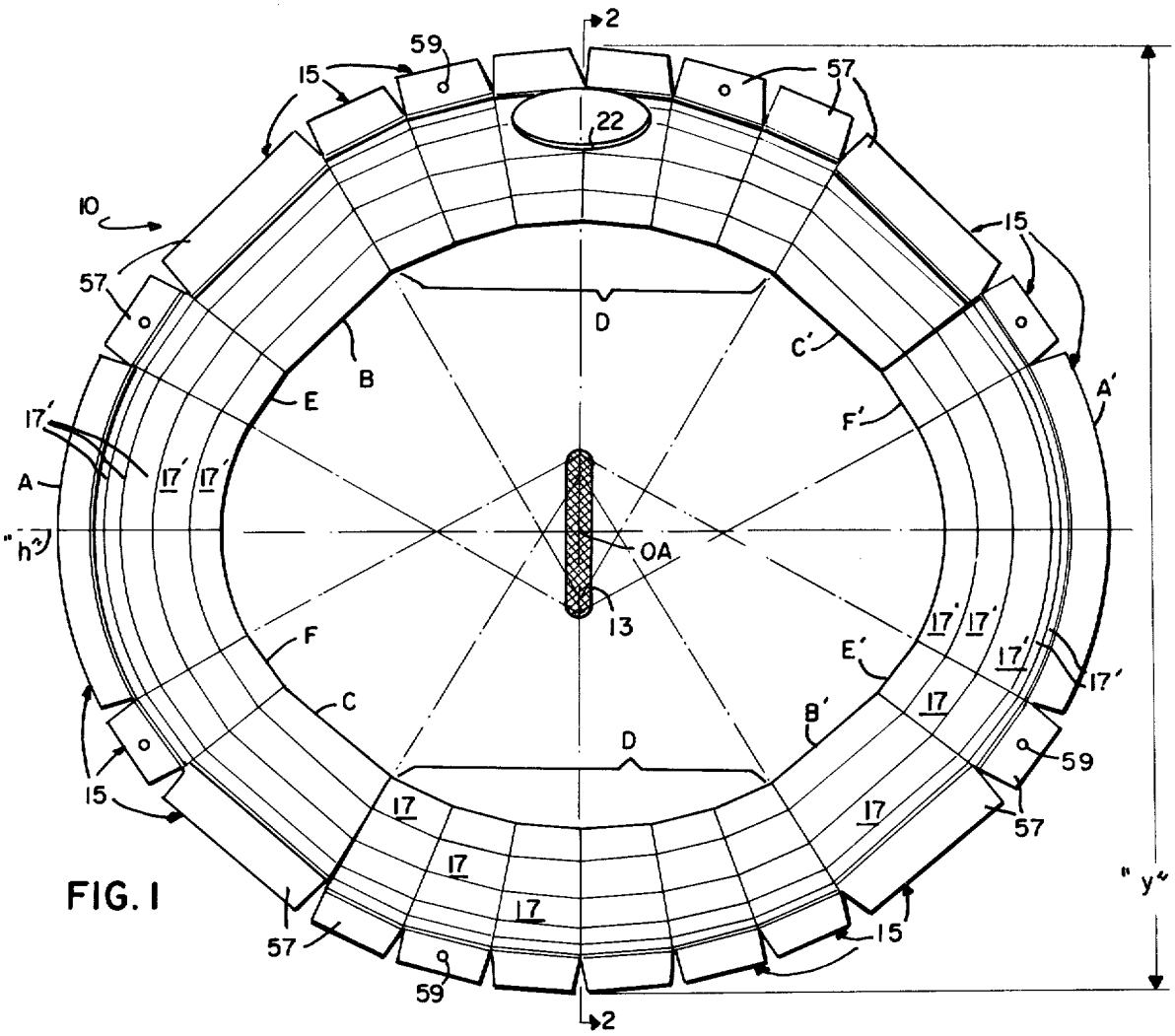
FIG. 1 is a plan view of a reflector in accordance with a preferred embodiment of the invention, as looking through the forward opening thereof.
Figure 2:
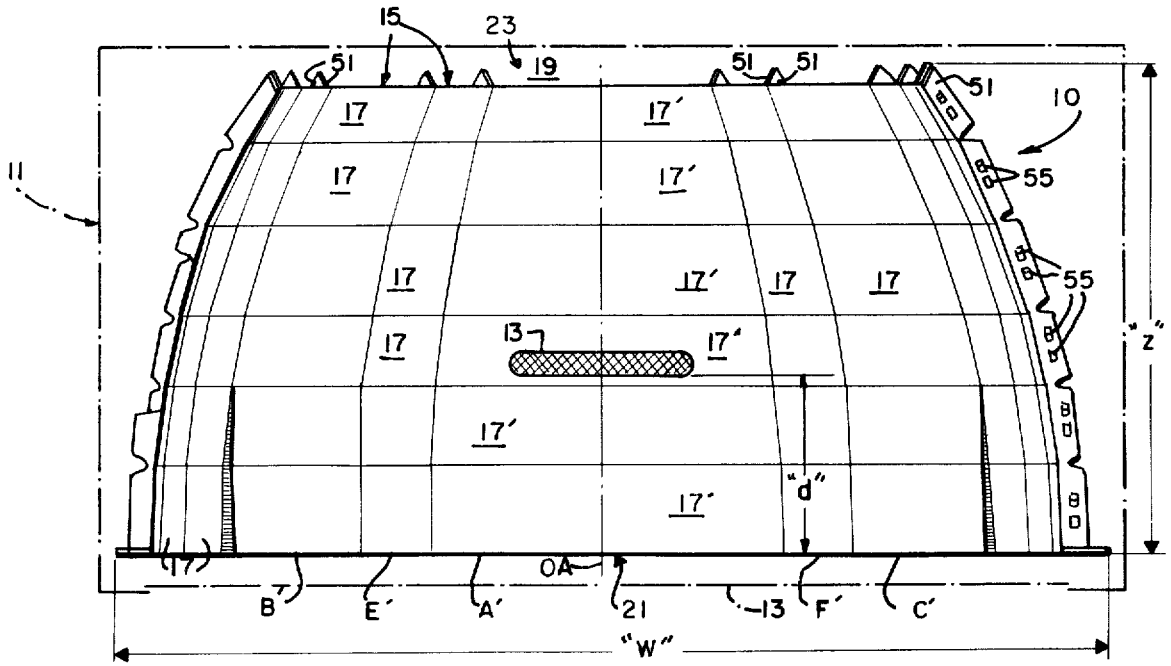
FIG. 2 is an elevational view of the invention as taken along the line 2—2 in FIG. 1.

With particular reference to FIGS. 1 and 2, there is shown a reflector 10 in accordance with a preferred embodiment of the invention. Reflector 10 is adapted for being positioned within the housing of a luminaire 11 (shown in phantom in FIG. 2) to direct light from the luminaire's light source 13 onto a subject field located an established distance from luminaire 11. The invention is ideally suited for use in direct lighting luminaires; that is, the resulting field of illumination is located directly below the luminaire. Accordingly, the light as reflected by reflector 10 is directed through a light-transmitting panel 13 or similar member located in the bottom portion of the luminaire's housing.

Reflector 10 includes a plurality of adjoining segment members 15, each of which include a plurality of reflective facets 17 (or 17') thereon. For reasons of simplification, only a representative number of facets 17 are numerated in FIGS. 1 and 2. Each segment 15 includes a total of six facets with each facet preferably specularly reflective. By specularly reflective is meant that the angle of the incoming pencil (or ray) of light and a normal to the facet's surface is equal to the angle of the outgoing, reflected pencil and said normal. Suitable examples of such materials include polished and electroplated metals, first-surface silvered glass or plastic mirrors. In the present invention, each segment 15 is produced from 0.025 inch thick preanodized aluminum sheets to assure that reflector 10 will possess the highly desired characteristic of being lightweight. As an example, reflector 10 as produced using the above material and thickness weighed only 1.562 pounds. Each segment is cut therefrom and formed by a series of bending operations to define the several facets 17 thereon. The resulting contour for each segment approximates an elliptic paraboloid, recognized in the industry as one of the most efficient reflecting contours known. It is understood that the term "contour" is used to define the radial configuration of each segment from the reflector's apex region 19 (FIG. 2) to the forward, emitting opening 21 as viewed in planes passing through the reflector's optical axis OA. Axis OA is perpendicular to the drawing in FIG. 1 and passes through the center of reflector 10 as well as light source 13. This axis is also perpendicular to the plane occupied by the reflector's forward opening 21. Facets 17 are planar and, with the exception of those (17') on two of the segment members of the invention, maintain this flat shape within reflector 10. The facets of each segment, which are formed as a result of the aforedescribed bending operation, thus combine with the remaining facets in the respective segment to approximate the defined contour. That is, straight line approximations of the cross-section of these facets fall along said contour. In the case of the two segment members mentioned as exceptions above, each of these facets have a surface best defined as constituting a curved plane. These facets are represented by the numerals 17' in FIGS. 1 and 2. It is of course understood that straight line approximations of cross-sections of these facets also lie on the described contour (elliptic paraboloid) of their respective segment members. In FIG. 1, these segments (A, A') are shown as being oriented in reflector 10 in an opposing manner. Further description of these components and their respective contributions to the light pattern produced by the invention will be provided below. As a result of the described bending operation, each of the facets of a single segment member forms an angle with the facet adjacent thereto. The resulting angles can best be defined in relation to optical axis OA which, as stated, is perpendicular to the reflector's planar forward opening 21. Those facets located about the periphery (and thus nearest) of opening 21 form an angle of about 2 degrees with axis OA while those about the periphery of a rear aperture 23 within the reflector form an angle of about 35 degrees with said axis.

Reflector 10 is ideally suited for use within luminaires utilizing high intensity discharge (HID) lamps as their light source 13. Such lamps are well known in the lighting industry as possessing high efficacy, long life, and good lumen maintenance. HID lamps also provide a compact light source to permit effective light control thereof. The three principle HID lamps currently on the market are mercury, high pressure sodium, and metal halide. Typical wattages for such lamps are 175/250, 400, and 1000. These lamps typically have an elongated lighted length (i.e. discharge tube) and, when used in combination with the present invention, are arranged such that this lighted length lies in a plane perpendicular to optical axis OA. With still further regard to the invention, the segment members 15 of reflector 10 are positioned so as to surround source 13; that is, source 13 occupies a preestablished depth (dimension "d") within the concave shaped reflector. A hole 22 is provided within reflector 10 to accommodate the lamp for use in luminaire 11, in the event a lamp requiring horizontal alignment is preferred. It is of course understood that reflector 10 is adapted for use with other forms of HID lamps. Hole 22 is not shown in FIG. 2.

In addition to forward opening 21 through which the facets of the invention reflect light from source 13, reflector 10 also includes the described rear aperture 23 within the apex portion thereof. The invention is thus particularly adapted for use in luminaires wherein a reflective surface is included therein and located adjacent aperture 23 to receive the direct light from source 13 and reflect it back through opening 21 and/or onto facets 17 and 17'. It is to be understood, however, that the present invention is capable of producing the desired, controlled pattern of light without the necessity for such a surface. In the luminaire defined in Ser. No. 025,258, this surface is provided primarily to supply supplemental illumination to the resulting light pattern, as may be desired in some environments. Both forward openings 21 and rear aperture 23 are of substantially elliptical configuration, as defined by segments 15.

Figure 3:
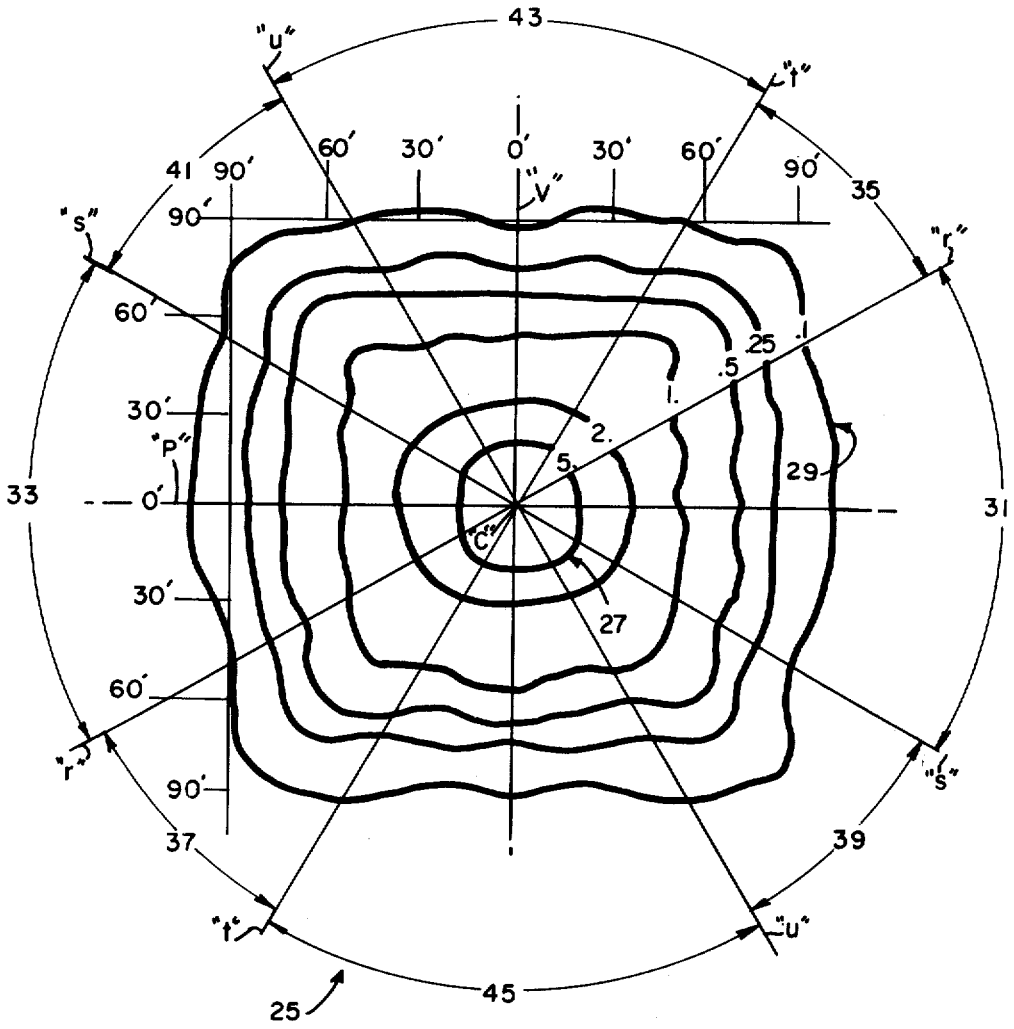
FIG. 3 is a two dimensional intensity contour of an illumination pattern as produced by a luminaire utilizing the present invention.

A key feature of the instant invention is the combination of facets 17, 17 in a unique arrangement to synthesize a desired, controlled pattern of illumination on a subject field below illuminaire 11. In other words, the facets of reflector 10 are each oriented so as to reflect light from source 13 to an appropriate location within the pattern. The result of this synthesizing is a pattern (25) having a substantially rectangular configuration, as illustrated in FIG. 3. Such a pattern possesses all the significant advantages described above.

Pattern 25 represents an isolux plot of horizontal footcandles as produced by a luminaire on a planar subject field (surface) when the luminaire, containing the instant invention, is located at a height of 30 feet. Pattern 25 is substantially square, having sides approximately 180 feet in length and is produced when the luminaire-reflector is oriented in a horizontal position. Accordingly, the cut-off angle provided is approximately 70 degrees. It is understood that the reflector's optical axis OA is perpendicular to the subject field and passes through the center ("C") of pattern 25 when oriented in the aforedefined position. As illustrated, pattern 25 includes a central region (defined by peripheral boundary 27) of highest illumination circumscribed by regions of decreasing illumination. In one example, the luminaire-reflector assembly contained a 400 watt HID (e.g. sodium) lamp. Accordingly, the central region possessed an average reading of 5.0 footcandles while the outermost region (as defined by peripheral boundary 29) possessed an average reading of 0.1 footcandle. Other values are readily obtainable from FIG. 3. It can thus be seen that a lighting designer desirous of providing a minimum of 2.0 footcandles utilizing luminaires of the above example positioned in a side-by-side relationship would be required to space said luminaires apart a distance of about 90 feet. It is further understood that greater illumination readings are readily achieved using lamps of greater output, by reducing the luminaire's height, etc.

The unique orientation of segment members 15 which results in the production of pattern 25 can best be described in combination with the manner in which each of these segment members contributes to pattern 25. Accordingly, reference is made to the plan view of FIG. 1 in conjunction with FIG. 3. For purposes of orienting the reader, assume that the upper portion (having hole 22 therein) of reflector 10 as illustrated in FIG. 1 is tilted forward ninety degrees about a horizontal axis "h" such that this portion is now nearest the drawing's viewer. Understandably, the lower portion of reflector 10 as shown in FIG. 1 is now farthest from the viewer. To orient pattern 25, assume that the bottom portion of the pattern as shown in FIG. 3 is tilted toward the viewer ninety degrees about a horizontal axis "P." The bottom portion is now nearest the viewer while the upper portion (that above axis "P") is farthest away. The following description of the contributions of segment members 15 of reflector 10 to the respective portions of pattern 25 is provided when considering reflector 10 and pattern 25 in the above tilted orientation, and assuming further that both are horizontally aligned with reflector 10 located above pattern 25 at the aforedescribed height (thirty feet).

Reflector 10 includes a first pair (A, A') of segment members 15 which are positioned within the reflector in an opposing relationship. Each segment includes six facets 17'thereon which are of the aforedefined curved plane configuration. Curved facet surfaces are utilized in these portions of the reflector to enhance light collection and reflection from light source 13, particularly when source 13 is a horizontally aligned HID lamp. It is well established in the HID lamp art that the greatest amount of light from the lamp is emitted from the sides thereof; that is, along the longitudinal sides of its lighted length (e.g. discharge tube). Curved facets 17' are thus located to receive the majority of this light and direct it to pattern 25. With consideration of the above reflector-pattern arrangement, the facets of the first segment (A) of this first pair primarily direct light onto a first side portion 31 of pattern 25. First side portion 31 is defined as that portion of pattern 25 defined by a line ("r") passing through the center "C" of the pattern and subtending an angle of about thirty degrees above horizontal axis "P," and another line ("s") also passing through center "C" and subtending an angle of thirty degrees below the horizontal axis. Similarly, the facets of the second of these segments (A') primarily reflect light to a second side 33 of pattern 25 which is located opposite first side 31 and also defined by lines "r" and "s" as extended through center "C."

Reflector 10 further includes a second pair (B, B') of opposingly oriented segment members. The first (B) of these primarily reflects light onto a first corner portion 35 of pattern 25 as defined by line "r" and a line "t" passing through center "C" and subtending an angle of approximately thirty degrees from line "r." Similarly, second segment B' primarily reflects light onto a second corner portion 37 located opposite first corner 35 and defined by lines "r" and "t" as extended through center "C." A third pair (C, C') of segment members is provided within reflector 10 to contribute to the remaining corner portions of rectangular pattern 25. A first (C) of this third pair primarily reflects light onto a third corner portion 39 defined by a line "u" which subtends an angle of thirty degrees from line "s." Third corner 39 is thus located adjacent first side portion 31. Similarly, the second segment (C') of this third pair, which is located opposite first segment C within reflector 10, primarily reflects light onto a fourth corner portion 41 located opposite third corner 39. Forth corner 41 is defined by extensions of lines "s" and "u" which understandably form a thirty degree angle from center point "C." As illustrated in FIGS. 1 and 2, the facets of second and third opposing pairs B, B' and C, C', respectively, are planar. As even further illustrated in FIG. 1, the lower two facets (those located nearest forward opening 21) of each segment B, B', C and C' is advanced inwardly toward optical axis OA more than the respective facets of adjoining and other remaining segments. This advancement enhances the reflection of light onto the outermost regions of the described four corner portions, thereby assuring the rectangular configuration of intensity zones illustrated.

The remaining portions of pattern 25 are illuminated by a pair of groupings (D, D') of segment members arranged on opposite sides of reflector 10. Each grouping includes six segments 15 which in turn have six planar facets 17 thereon. The first grouping D reflects light primarily onto a third side portion 43 of pattern 25 located between the aforedefined first and fourth corner portions 35 and 41, respectively. Side 43 is therefore defined by lines "t" and "u," which form an angle of sixty degrees at center "C." It is understood from the foregoing that this angle is equally subdivided (thirty degrees on each side) by a vertical axis "V" which intersects horizontal axis "P." The second grouping D' similarly reflects light primarily onto a fourth side 45 equal in size and opposite third side 43.

It is preferred in the invention to provide reflector 10 with fourth and fifth opposing pairs of segment members for purposes of providing illumination primarily onto the regions of pattern 25 where first and second sides 31 and 33 adjoin the defined four corner portions 35, 37, 39, and 41. This lighting is desired primarily to provide a "smoothing" effect at these locations and thereby prevent undesirable interaction between portions of pattern 25 of potentially varying intensity levels. A first segment E of the fourth opposing pair E, E' primarily reflects light onto a region marking the convergence of first side 31 and first corner 35. Basically, the total area onto which segment E directs almost the entirety of its light is represented by an angle within the range of five to ten degrees on each side of line "r." Similarly the second segment E' of this fourth opposing pair illuminates an area located on pattern 25 directly opposite that illuminated by segment E. That is, this area lies from five to ten degrees on both sides of the line "r" extended through center "C" and which forms the convergence between second side 33 and second corner 37. In similar fashion, the first segment F of fifth opposing pair F, F' directs lighting onto a region similar in size to those above and intersected by line "s" between first side 31 and third corner 39. The second segment F' of this fifth pair serves to primarily illuminate an area opposite that above as illuminated by segment F and intersected by the extended line "s" which lies between second side 33 and fourth corner 41. Each of the facets of all four segment members E, E', F and F' is planar.

One of the key features of the invention is that the facets of segments 15 are oriented with respect to light source 13 such that none of the reflected light passes back through source 13. Passage of light through the luminaire's light source and the resulting absorption of radiant energy thereby causes an undesirable voltage rise in typical HID lamps, the effect of which can be to alter the lamp's output and/or shorten the operating life thereof. Understandably, the present invention prevents this occurence.

Assembly of reflector 10 is accomplished by providing each segment 15 with a pair of opposing flanges 51. Each flange is designed to align with an adjacent flange of the next, adjoining segment. A specially designed tool is utilized to form (e.g. punch) a pair of tab sections 55 within each portion of the flange corresponding to one of the facets 17. These tabs are interlocked by the forming tool to thus bind adjoining flanges together. That is, punching and forming is done instantaneously through the flange of one segment and the adjoining flange of the next segment. Proper orientation of segments 15 prior to the described securement is achieved using a mold around which said segments are located. It is thus understood that reflector 10 readily lends itself to assembly and disassembly (e.g. to effect repair). It is also understood that this capability adds versatility to the invention in that it is readily possible to mix segments of varying reflective finishes to accomplish a multiplicity of distribution patterns. To enhance securement of the assembled reflector within luminaire housing 11, base flanges 57 are provided on each segment 15 and are adapted for lying flush upon a corresponding, flat base member (not shown) of housing 11. Holes 59 are provided in various flanges 57 about the periphery of the reflector in which screws, bolts, etc. may be located.

In the embodiment of the invention as shown in FIGS. 1 and 2, reflector 10 has a maximum external width "w" of about 18.25 inches, a minimum external width "y" of about 17.125 inches and a height "z" of about 8.75 inches. The corresponding maximum internal widths of forward opening 21 are about 17.75 and 16.25 inches, respectively. The corresponding internal dimensions of the smaller, rear aperture 23 are 12.75 and 11.25 inches, respectively. Light source 13 occupies a depth (dimension "d") of about 3.5 inches.

Thus there has been shown and described a unique reflector design for use in direct lighting luminaires for purposes of providing a rectangular (i.e. square) pattern of illumination in a subject field therebelow. The design is lightweight, permits exceptional ease of assembly and disassembly, and is capable of being produced at relatively low cost. The flat surfaces of the reflector's facets are readily adaptable to a changing focal position image of the preferred light source for the luminaire, an HID lamp having an elonagated lighted length. The defined facet arrangement also compensates for another undesirable characteristic of HID lamps, that being an irregularity of light distribution in the plane of the lamp's axis. As defined, this distribution (output) is greatest along the longitudinal sides of the lamp's arc discharge tube. It is also common in lamps of this variety for the output to approach zero on the base end of the lamp and approach some value between zero and the maximum output at the opposing end of the lamp.

As also defined, the invention assures a relatively sharp cut-off angle (e.g. seventy degrees) on the pattern of illumination to thus maximize light output to regions thereof and facilitate aligning the invention with luminaires possessing similar devices.

While there have been shown and described what are at present considered the preferred embodiments of the invention, it will be obvious to those skilled in the art that various changes and modifications may be made therein without departing from the scope of the invention as defined by the appended claims.

We claim:

1. A concave reflector for being positioned within a luminaire having an elongated light source therein and adapted for illuminating a subject field located an established distance therefrom, said reflector comprising:

a plurality of adjoining segment members defining a forward opening for said reflector and adapted for substantially surrounding said elongated light source, each of said segment members including a plurality of reflective facets thereon, said facets arranged to reflect light from said elongated light source through said forward opening of said reflector and produce a substantially rectangular, controlled pattern of light on said subject field, each of said segment members arranged such that the facets thereof reflect light primarily onto only a preselected portion of said rectangular pattern of light on said subject field.

2. The reflector according to claim 1 wherein said facets reflect said light from said light source through said forward opening of said reflector without said light passing through said light source.

3. The reflector according to claim 1 including an aperture within the apex portion thereof.

4. The reflector according to claim 3 wherein said forward opening of said reflector and said aperture are of substantially elliptical configuration.

5. The reflector according to claim 1 wherein said forward opening of said reflector occupies a plane, said reflector including an optical axis passing through the center thereof and substantially perpendicular to said plane of said forward opening.

6. The reflector according to claim 5 wherein said optical axis passes through said light source.

7. The reflector according to claim 6 wherein said light source lies in a plane substantially perpendicular to said optical axis.

8. The reflector according to claim 1 wherein each of said facets is specularly reflective.

9. The reflector according to claim 1 wherein the contour of each of said segment members is an elliptic paraboloid.

10. The reflector according to claim 1 including a first opposing pair of segment members each having a plurality of facets thereon, the surface of each of said facets comprising a curved plane, said facets of a first segment of said first opposing pair primarily reflecting light from said light source to a first side portion of said retangular pattern, said facets of a second of said first opposing pair primarily reflecting light from said light source to a second side portion of said rectangular pattern, said second side portion located opposite said first side portion of said pattern.

11. The reflector according to claim 10 including second and third opposing pairs of segment members each having facets thereon of substantially planar configuration, said facets of a first segment of said second opposing pair primarily reflecting light from said light source to a first corner portion of said rectangular pattern, said facets of a second segment of said second opposing pair primarily reflecting light from said light source to a second corner portion of said rectangular pattern located opposite said first corner portion, said facets of a first segment of said third opposing pair primarily reflecting light from said light source to a third corner portion of said rectangular pattern, and said facets of a second segment of said third opposing pair primarily reflecting light from said light source to a fourth corner portion of said rectangular pattern located opposite said third corner portion.

12. The reflector according to claim 11 wherein at least one of said planar facets on each of said second and third opposing pairs of segment members is more advanced toward said light source than the facets of the remaining segment members of said reflector, said advanced facets located near said forward opening of said reflector.

13. The reflector according to claim 11 including a fourth opposing pair of segment members, each of said fourth opposing pair having facets thereon of substantially planar configuration, a first segment of said fourth opposing pair located within said reflector between said first segment members of said first and second opposing pairs of segment members, a second segment of said fourth opposing pair located within said reflector between said second segment members of said first and second opposing pairs of segment members, said facets of said first segment of said fourth opposing pair primarily reflecting light from said light source to the region of said rectangular pattern between said first side portion and said first corner portion, said facets of said second segment of said fourth opposing pair primarily reflecting light from said light source to the region of said rectangular pattern between said second side portion and said second corner portion.

14. The reflector according to claim 13 including a fifth opposing pair of segment members, each of said fifth opposing pair having facets thereon of substantially planar configuration, a first segment of said fifth opposing pair located within said reflector between said first segment members of said first and third opposing pairs of segment members, a second segment of said fifth opposing pair located within said reflector between said second segment members of said first and third opposing pairs of segment members, said facets of said first segment of said fifth opposing pair primarily reflecting light from said light source to the region of said rectangular pattern between said first side portion and said third corner portion, said facets of said second segment of said fifth opposing pair primarily reflecting light from said light source to the region of said rectangular pattern between said second side portion and said fourth corner portion.

15. The reflector according to claim 10 including first and second groupings of segment members located within said reflector in an opposing relationship, each of said first and second groupings including a plurality of facets thereon of substantially planar configuration, said facets of said first grouping primarily reflecting light from said light source to a third side portion of said rectangular pattern, said facets of said second grouping primarily reflecting light from said light source to a fourth side portion of said rectangular pattern, said fourth side portion located opposite said third side portion.

16. The reflector according to claim 1 wherein said controlled pattern of light is substantially square.

* * * * *